United States Patent [19]

Johnson

[11] Patent Number: 5,039,091

[45] Date of Patent: Aug. 13, 1991

[54] EXERCISE MACHINE HAVING FLYWHEEL WITH VARIABLE RESISTANCE

[76] Inventor: Michael R. Johnson, 2889 Longleaf La., Palm Harbor, Fla. 34684

[21] Appl. No.: 600,385

[22] Filed: Oct. 19, 1990

[51] Int. Cl.[5] ..... A63B 21/00

[52] U.S. Cl. ..... 272/131; 272/128; 272/143

[58] Field of Search ..... 272/131, 132, 128, 76, 272/77, 78, 73, 143, 93; 434/252

[56] References Cited

U.S. PATENT DOCUMENTS

| | | | |
|---|---|---|---|
| 319,686 | 6/1885 | Farmer | 272/131 |
| 3,614,108 | 10/1971 | Garten | 272/143 |
| 4,471,957 | 9/1984 | Engalitcheff | 272/143 |
| 4,491,316 | 1/1985 | Prince | 272/78 |
| 4,749,184 | 6/1988 | Tobin | 272/78 |

*Primary Examiner*—Stephen R. Crow

*Attorney, Agent, or Firm*—Joseph C. Mason, Jr.; Ronald E. Smith

[57] ABSTRACT

An exercise machine that enables an exerciser to perform golf club swings, baseball bat swings, canoeing strokes, football kicks, tennis serves, ball throwing, weight lifting, bike exercise, and numerous other athletic motions with preselected amounts of resistance. The machine incorporates a free wheeling flywheel having variable resistance in one direction so that backswings are accomplished with no substantial resistance. The flywheel is positionable and lockable at a height selected by the user, and is further positionable and lockable at any preselected angle relative to a horizontal axis and at any preselected angle relative to an axis orthogonal to the horizontal axis. Attachments that simulate golf clubs, baseball bats and the like are secured to the axle of the flywheel and are swung or otherwise manipulated by the exerciser to increase the strength of muscles specifically used during the selected athletic motion.

17 Claims, 10 Drawing Sheets

EXERCISE MACHINE HAVING FLYWHEEL WITH VARIABLE RESISTANCE

TECHNICAL FIELD

This invention relates, generally, to exercise machines that have more than one operative configuration. More particularly, it relates to a device that enables an exerciser to perform golf, tennis, baseball and other sport movements under varying degrees of resistance to thereby develop specific muscles of the exerciser.

BACKGROUND ART

Exercise machines are typically dedicated to a specific exercise. For example, in the well-known Nautilus (TM) family of exercise machines, one machine is dedicated to strengthening the neck muscles of the exerciser, another is dedicated to the triceps, and so on. On some of the machines, different exercises can be performed but none of the machines, standing alone, offers a wide variety of exercises.

Nautilus brand exercising machines are also very large and heavy and thus are not suitable for home use.

A number of inventors have developed relatively small and light-in-weight exercise machines, suitable for use in a home, that provide a large number of different exercises. These machines have met with limited success in the market place because they do not provide the practical exercises that most active people want. For example, a golfer desiring to increase the strength of the muscles that are used during a golf swing receives little help from a machine that helps increase the strength of the biceps and other muscles that play only a peripheral role during a golf swing.

Similarly, most exercise machines do not provide resistance to the muscles that a baseball or softball player uses when swinging a bat or throwing a ball. Moreover, few machines can help a kicker on a football team increase the range of kickoffs or field goals.

Perhaps more importantly, the art has heretofore failed to develop an exercise machine that provides all of the foregoing functions, and much more.

There is an unresolved need, then, for an exercise machine that builds specific muscles that are used in specific athletic activities such as golfing, baseball, canoeing, ball throwing, kicking, biking and the like, but the prior art, taken as a whole, neither teaches nor suggests how such a machine could be built.

DISCLOSURE OF INVENTION

The longstanding but heretofore unfulfilled need for an exercise machine not subject to the limitations of prior art machines is now provided in the form of a machine that has a variable resistance element that can be oriented in virtually any preselected position and that can be used with simulated golf clubs, baseball bats and balls, tennis rackets and the like. Significantly, the machine does not constrain the exerciser to adjust the swing or other athletic motion unless such constraint is desired for corrective training purposes.

The variable resistance element is a flywheel of the type usually found in stationary exercise machines often referred to as exercise bikes, even though they have but one wheel. The flywheel has an axle that defines its axis of rotation. On exercise bikes, crank arms and pedals are attached to the flywheel axle. A tension strap circumscribes the flywheel and serves as a brake; tightening the tension strap increases the resistive force presented by the flywheel.

The flywheel is of free-wheeling construction so that it continues to rotate, in a coasting manner, even when the exerciser discontinues the infusion of energy thereinto. Thus, the flywheel manifests an inertial effect when spinning rapidly.

In a first embodiment, only basic exercises and swing exercises can be performed.

In another embodiment, crank arms and pedals are attached to the flywheel at opposite ends of its axle so that the machine can be used as an exercise bike, and in still another embodiment, unique accessory members that simulate the feel of golfclubs, baseball bats or balls, tennis rackets, canoe paddles, bar bells, and the like are affixed to the axle. The resistance offered by the flywheel can be adjusted down to virtually no resistance at all and all the way up to a resistance so great that the selective exercise is performed only with maximum effort.

Importantly, the orientation of the flywheel is almost infinitely adjustable. A first selector means or stop member in the form of a perforated plate or dial locks the flywheel into a preselected angle relative to a first horizontal axis and a second stop member locks the flywheel into a preselected angle relative to an axis orthogonal to the horizontal axis. Moreover, the flywheel is movable in a generally vertical direction as well to accommodate exercisers of differing heights and to provide differing exercise functions.

It is therefore understood that the primary object of this invention is to pioneer the art of exercise machines that enable the exerciser to adjust the resistance to many athletic motions so that specific muscles in those motions are strengthened.

These and other objects, advantages and features of the invention will become more clear as this description proceeds.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODE FOR CARRYING OUT THE INVENTION

Figure 1:
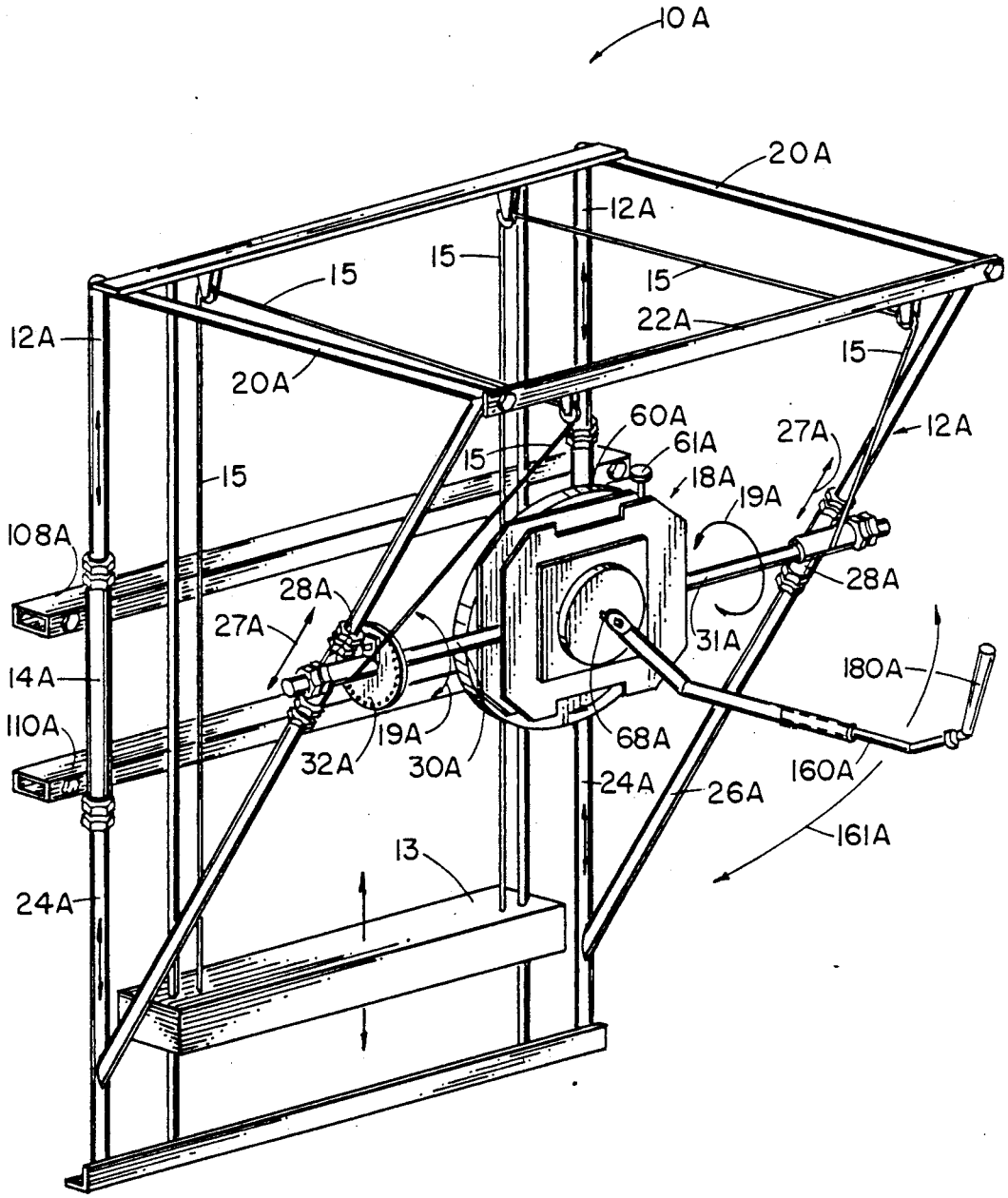
FIG. 1 is a perspective view of a first, simplified embodiment of the novel machine.

FIG. 1 depicts an early version of the preferred commercial embodiment of the present invention; it is denoted 10A as a whole.

Its frame includes a pair of laterally spaced apart triangular frame members, collectively denoted 12A, generally.

More particularly, frame 12A includes a pair of laterally spaced apart upstanding back frame members 24A, forwardly projecting top frame members 20A, transversely disposed connecting member 22A, and angularly disposed brace member 26A. Pillow blocks 28A are selectively positionable along the extent of brace members 26A as indicated by the double-headed directional arrow 27A. A discontinuous horizontal bar having parts 30A, 31A has its opposite ends carried by said pillow blocks 28A and said bars 30A, 31A are therefore selectively movable conjointly along the extent of the angularly disposed brace members 26A.

A flywheel assembly, generally denoted 18A, is supported by the respective inner ends of bars 30A and 31A and is rotatable about the axis of rotation defined by said bars, as indicated by the double-headed circular arrows 19A. The flywheel is denoted 60A; it is rotatable about its axle 68A and its resistance to rotation is adjustable through manipulation of knurled knob 61A. An elongate accessory arm 160A is attached to flywheel axle 68A at its proximal end and is swingable in the direction indicated by the double-headed directional arrow 161A. A backswing is not resisted by flywheel 60A because said flywheel has a one way sprag bearing. However, a forward swing is resisted dependent upon the setting of knob 61A.

A counterweight 13 and cables 15 interconnecting said counterweight 13 and bars 30A, 31A are provided in this embodiment to facilitate displacement of the flywheel assembly 18A along the extent of angularly disposed brace members 26A.

Semicircular flat plate or stop member 32A having perforations formed about the periphery thereof as shown is employed to selectively lock flywheel assembly 18A in any preselected position of rotational adjustment relative to bars 30A, 31A. Thus, where a golfclub-like auxiliary handle 180A is rotatably secured to the free end of accessory arm 160A, the exerciser may position flywheel assembly 18A at a desired height along the extent of diagonal brace members 26A, position the flywheel assembly 18A in the desired angular position for the swing, lock the assembly in the desired position by stop member 32A, and execute the swing with no resistance to the backswing and with the selected resistance to the forward swing.

It should be noted that in this embodiment, the flywheel assembly 18A is not rotatable about a vertical axis. This limits the number of exercises that may be executed. Accordingly, in the figures that follow, means will be shown whereby flywheel assembly 18A is additionally provided with an axis of adjustment orthogonal to the horizontal axis. Numerous other improvements and details of construction not shown in FIG. 1 will also be shown and described.

Figure 2:
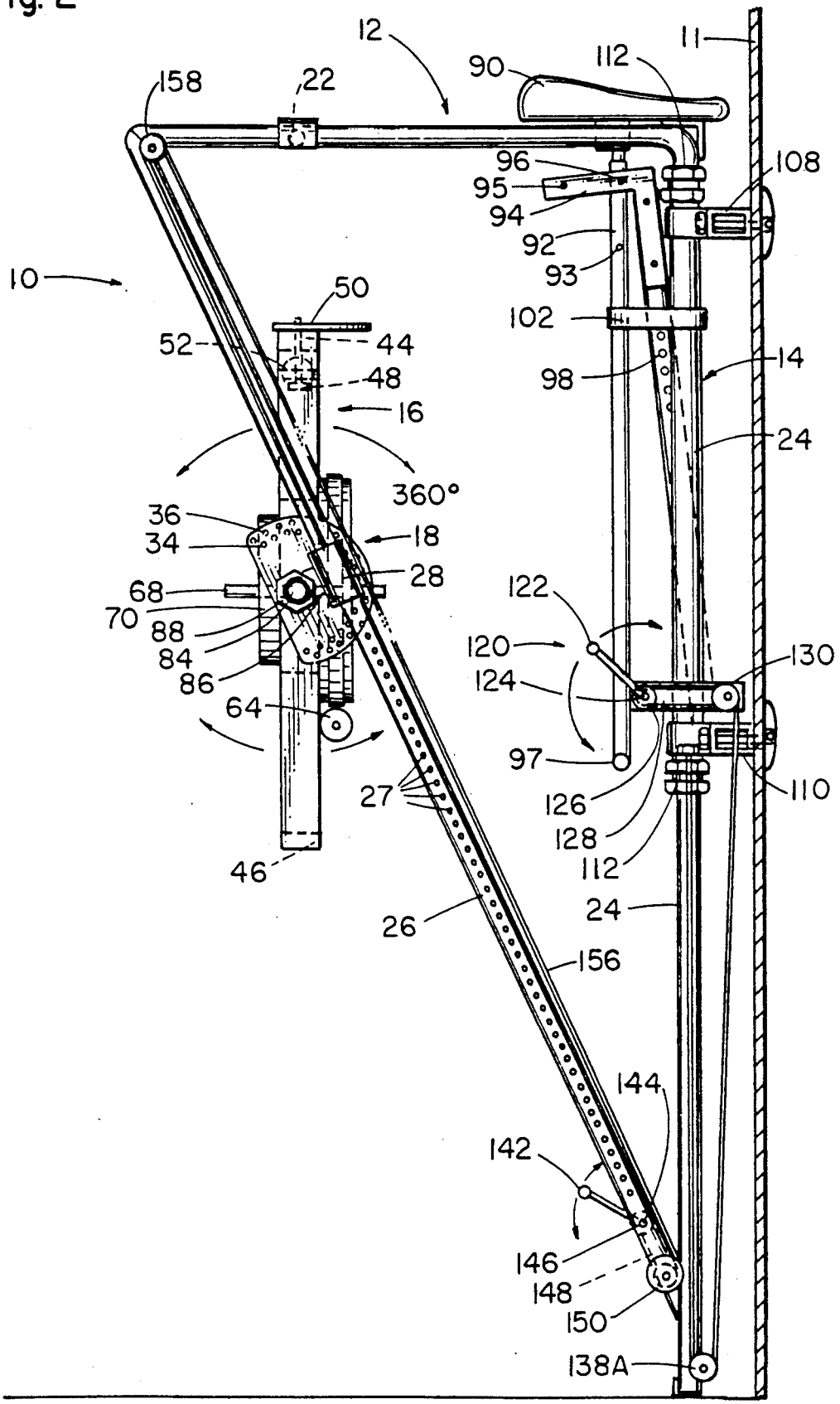
FIG. 2 is a side elevational view of a second exemplary embodiment of the invention.

Referring now to FIG. 2, it will there be seen that the numeral 10 indicates a preferred embodiment of the invention as a whole. A pair of laterally spaced apart triangular tubular supports are collectively and generally indicated by the numeral 12 (only one of which is visible in FIG. 2; both are visible in FIG. 1).

Each triangular tubular support 12 includes a forwardly projecting (relative to wall 11) horizontal top frame member 20, a transversely disposed, detachable connecting bar 22, a vertical back frame member 24, and a diagonal frame member 26 that extends in interconnecting relation between a forwardmost end of said top frame member and a lowermost end of said back frame member. The angularly disposed diagonal frame member 26 has a plurality of detent holes 27 formed along its extent.

Figure 3:
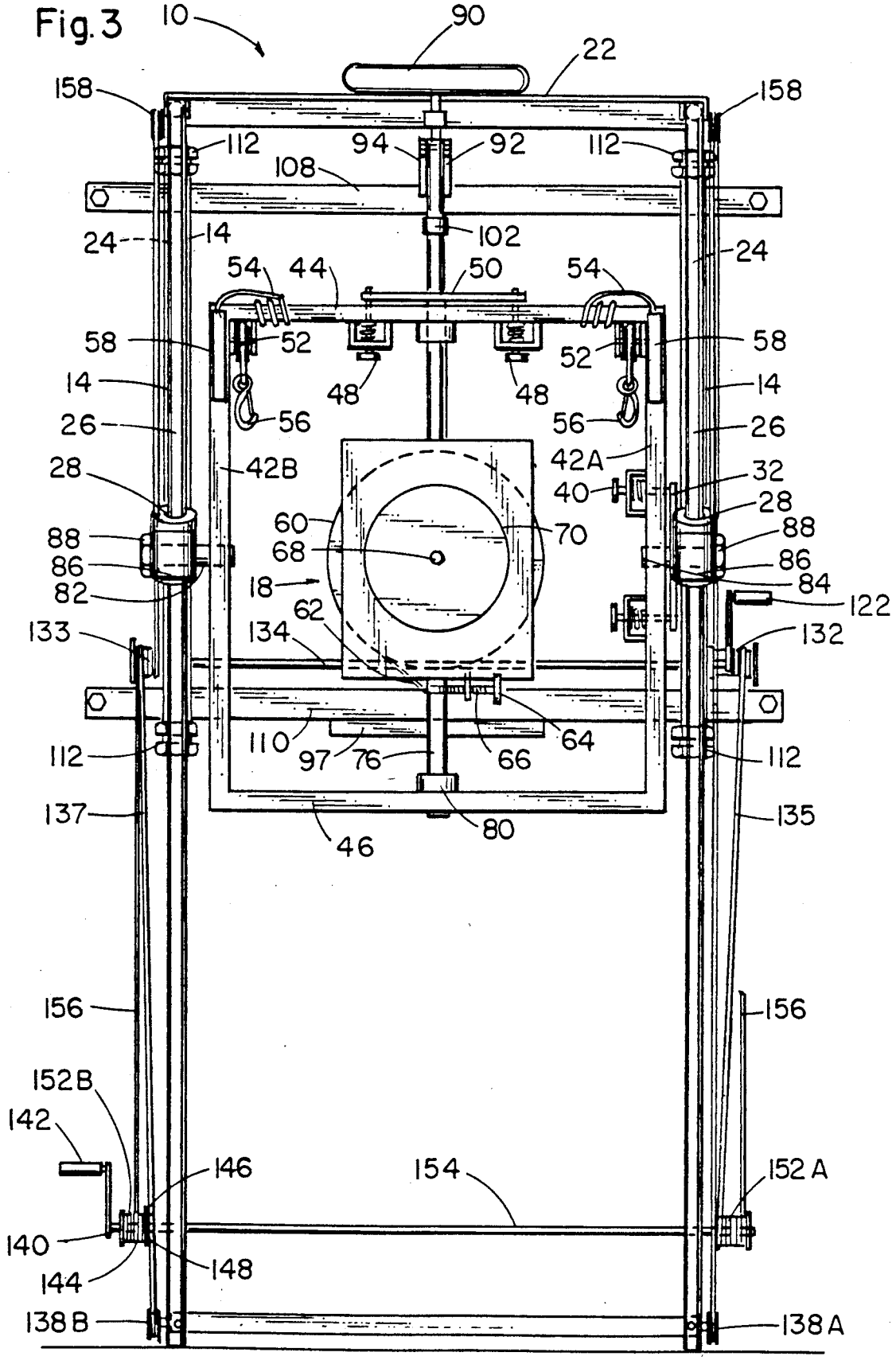
FIG. 3 is a frontal elevational view of said second embodiment in the same position disclosed in FIG. 1.

A rectangular frame is indicated by the numeral 16 and a flywheel housing is indicated by the numeral 18. (Frame 16 was not provided in the embodiment of FIG. 1). Mounted on each diagonal member 26 is a slidable pillow block 28 which supports the horizontal pintels or mounting sleeves 82, 84 of frame 16, as best shown in FIG. 3. Also mounted to one of the sliding pillow blocks 28 is an indicator and stop plate 32 in which are formed two radially spaced rows of circumferentially spaced perforations or holes 34 and 36 which receive either of two spring loaded detents 40 which are shown in FIG. 3. These are mounted on part 42A of the generally rectangular frame 16. Laterally opposed to part 42A is part 42B. Rectangular frame 16 includes upper horizontal frame member 44 and a lower horizontal frame member 46. It should be understood that as the frame is rotated, parts 44 and 46 thereof may be at the top or bottom or in any of the various three hundred and sixty degree positions.

Attached to the inside of frame member 44 are another pair of detent mechanisms 48 which communicate with an indicator dial or stop member 50 which is similar in structure to the stop member 32 previously described.

Also attached to the underside of the horizontal frame member 44 are a pair of pulleys 52 over which a pair of cables 54 passes. At one end of each cable 54 is a snap connector 56 and at the opposite ends of each of these cables 54 is a T-bar 58 which in this preferred embodiment has Velcro brand hook and loop fasteners applied to one side of each of said T-handles and with the corresponding Velcro fastener attached to the vertical frame members 42A and 42B to store the handles when they are not being used.

Flywheel assembly 18 includes rotatably mounted flywheel 60 having a friction band or tension strap 62 and a tensioning knob 64 which by means of the threaded part 66 of the knob 64 increases or decreases the tension of the tension strap 62 about the flywheel. The flywheel is mounted on a central axle 68. Enclosure 70 includes a planetary gear system; it should be understood that said gear system, the flywheel 60 and the tensioning strap 62 are all commercially available items.

The flywheel assembly 18 is mounted within a housing 72 from which there extends vertically above and below a pair of mounting pintels 74 and 76 which are pivotally mounted in journals 78 and 80 respectively, which are themselves mounted on the horizontal members 44 and 46 of the frame 16. At the outer end of pintel 74 is an indicator and stop plate 50 in which are formed two radially spaced rows of circumferentially spaced perforations or holes 34 and 36, which receive either of two spring loaded detents 48. It should be understood that flywheel housing 18 can rotate in the vertical axis within frame 16 in any of the various three hundred and sixty degree positions. This feature is not provided in the embodiment of FIG. 1.

Outboard and to the left and right of the frame 16 are mounting pintels 82 and 84 which are pivotally mounted in the pair of journals 86 which have compression nuts 88 to stabilize the frame 16 after it has been rotatably positioned to the user's choice.

Bicycle seat 90 (top of FIGS. 2 and 3) is conventionally mounted on a post 92 which is pivotally mounted between a pair of angle brackets 94 at 96. Bracket 94 is rigidly affixed to a swing arm 98 which is hingedly connected to transverse brace 110 (FIG. 2).

Figure 7:
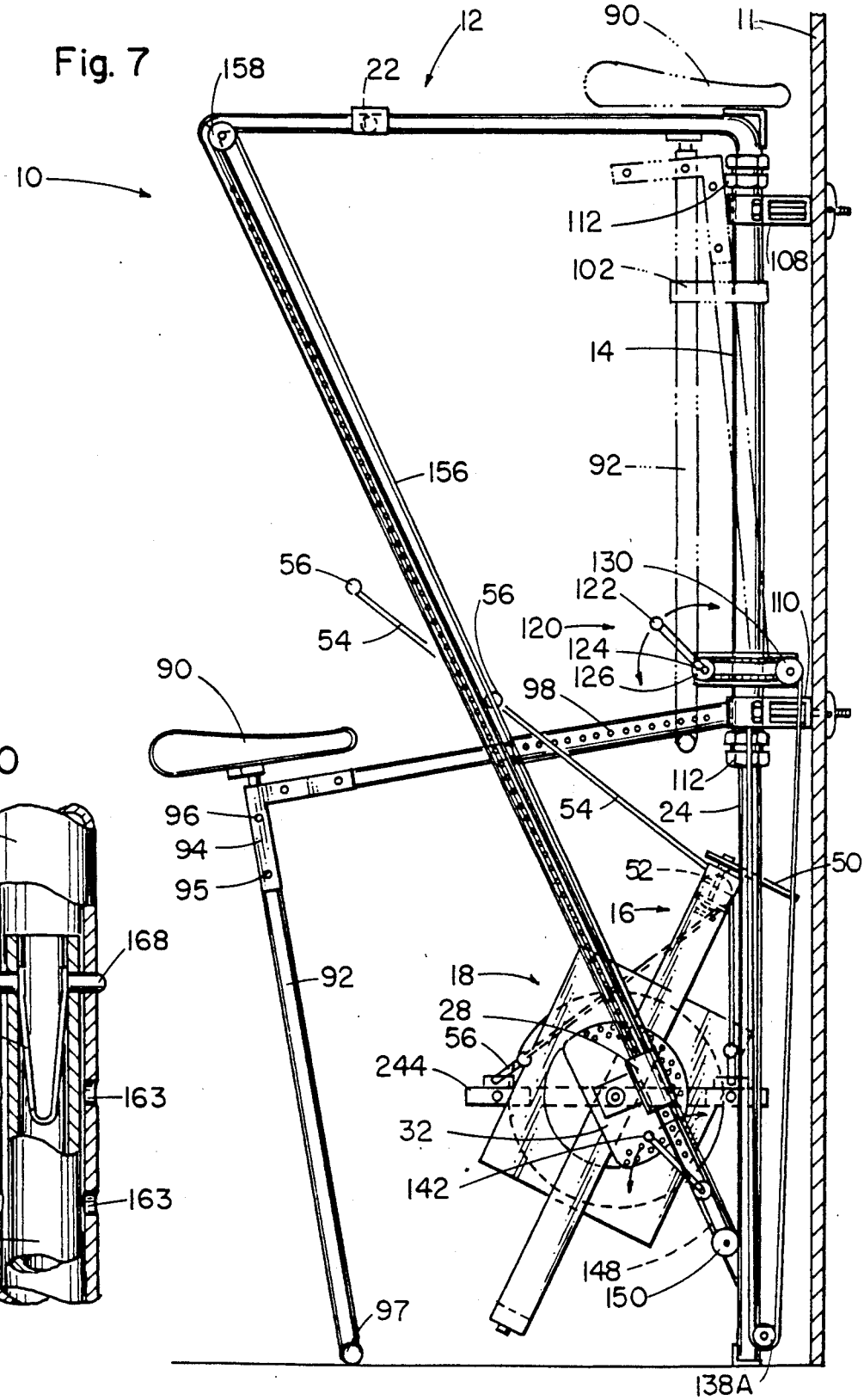
FIG. 7 is a side elevational view showing the bicycle riding seat in its operable position with the flywheel assembly in the bicycle riding position.

When seat 90 is deployed in the exercise bicycle position, as shown in FIG. 7, holes 93 and 95 align with one another and are temporarily pinned to lock the apparatus into said exercise bicycle configuration. At the bottom of the post 92 is a horizontal, transversely disposed length of tubing 97 which rests on the floor, as best shown in FIG. 7. A Velcro fastener strap 102 is positioned about the bracket and the swingable member 98 to retain the bicycle seat in its stored position when not in use.

Back frame members 14 are clamped by a strap or other suitable means to a pair of horizontal, transversely disposed brace members 108 and 110 which are themselves mounted to wall 11 (FIG. 2) or a free standing L-shaped support member (not shown).

At the upper and lower extreme ends of the back frames 14 are compression nuts 112 for the purpose of stabilizing and locking the triangular support members 12 for use in the various vertical positions of said triangular support members.

Attached to back frame 14 is a crank mechanism 120 with arrow (right center of FIG. 2), said mechanism including a hand crank 122 attached to a rotatable member 124 having sprockets 126 and a chain 128 which engages sprocket 130, and the axle of which communicates with a take up drum 132 (right center of FIG. 3). The shaft of the sprocket 130 and the drum 132 is a jack shaft 134 which communicates with another take up drum 133 on the left side of the device as depicted in FIG. 3. Cables 135 and 137 proceed around a permanently fixed pulley 138A and 138B at the bottom of the triangular member 12. The cables proceed around pulleys 138A and 138B and upward and are affixed to the bottom of the back frame members 14. Accordingly, when crank 122 is rotated in a predetermined direction, cables 135 and 137 are wound onto their respective drums 132 and 133, which raises or extends triangular support members 12.

Located at the lower left of the machine 10 as depicted in FIG. 3 is another crank mechanism 140 having handle 142 and axle 144 which communicates with a sprocket 146, a chain 148 and a sprocket 150 (lower right corner of FIG. 2) which is permanently rotatably fixed to drums 152A and 152B, each located on either side of the triangular members 12. Jack shaft 154 communicates with the take up drums 152A and 152B, thereby providing a means for the crank mechanism 140 to simultaneously take up a cable 156 which proceeds around a pulley 158 (upper left corner of FIGS. 2 and 3) near the juncture of the horizontal member 20 and the diagonal member 26. As the cable 156 progresses over the pulley 158 it then is attached to the pillow blocks 28 thereby providing a means for raising and lowering the gyroscopically mounted rectangular frame 16. This frame adjusting means allows the frame to be raised and lowered in a parallel configuration at all times to preclude binding upon the diagonal tubes 26. This also eliminates the need for the user to physically raise and lower the gyroscopically mounted frame 16 as it could prove to be too heavy and/or cumbersome for some users. Once the flywheel frame is moved to its desired positions, locking pins are inserted into the holes of brace members 26 just below the pillow blocks 28.

Figure 4:
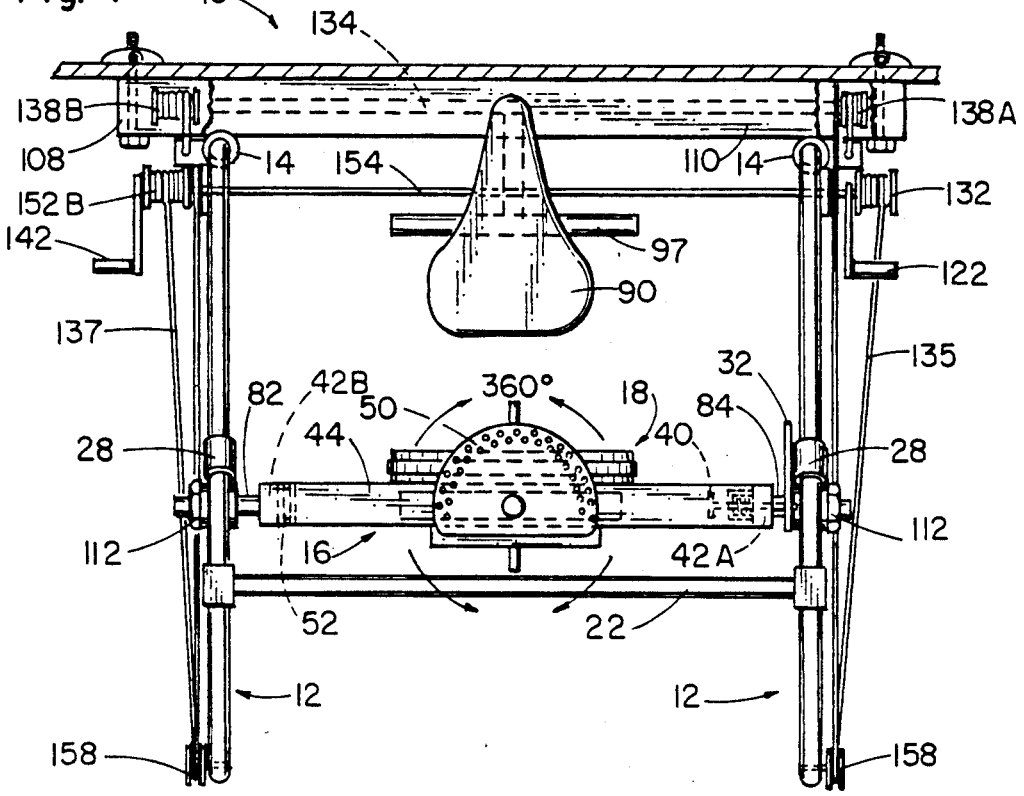
FIG. 4 is a top view thereof in the position shown in FIG. 2.

FIG. 4 perhaps best illustrates that flywheel housing 18 is rotatable three hundred and sixty degrees about an infinite number of axes orthogonal to the horizontal axis of rotation. It also provides a better view of the detachable cross member 22 which is removed when the device is in a stored configuration. The gyroscopically mounted frame member 16 is also removed from the pillow blocks 28 and the triangular support members 12 are folded inwardly against the wall when the novel apparatus is packaged for delivery or stored.

Figure 5:
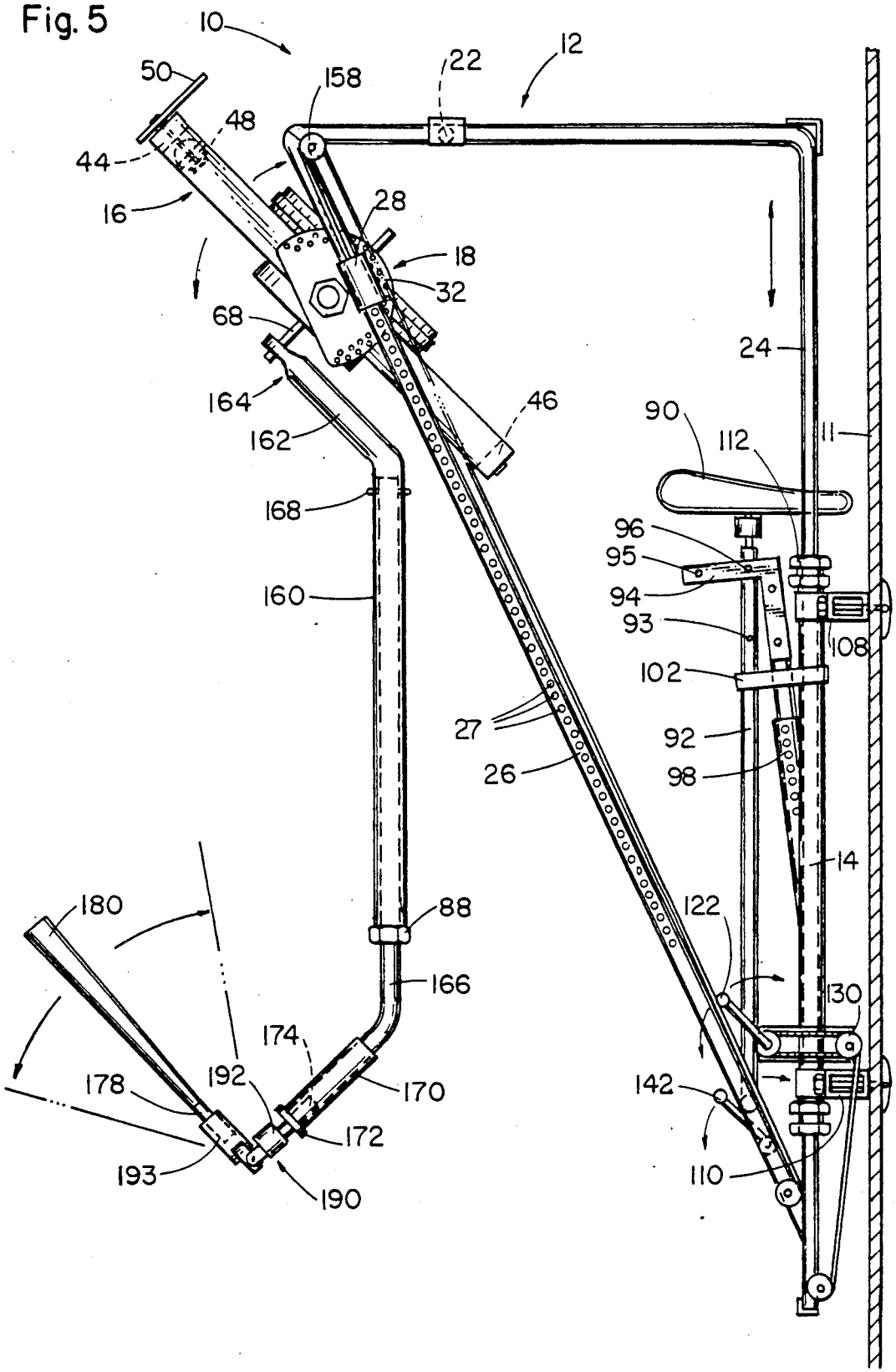
FIG. 5 is a side elevational view showing the flywheel in an oblique attitude of approximately forty five degrees for use in a golf swing, e.g.

In FIG. 5, frame 16 is raised nearly to the top of supports 12 and is positioned at approximately forty five degrees relative to wall 11. Long accessory member 160, hereinafter described, is attached to a preselected side of the crank and flywheel mechanism.

Accessory arm 160 simulates a piece of athletic equipment and includes an outer bent tube 162 which is affixed at its proximal end 164 to the flywheel axle 68 and a smaller inner tubing 166 is telescopically received therein, said inner tube 166 being adjustably extendable and retractable with respect thereto and which is positionable relative thereto by detents 168. At the distal end of the inner tubing 166 is an internally threaded receptor means 174. A universally jointed connector member 190 with arrow joins accessory member 160 and a simulated auxiliary golfclub handle 180. Connector member 192 has externally threaded part 178 screw threadedly received within receptor 174 and part 193 that screw threadedly receives any of the various auxiliary simulated handles. It should be noted that when these various auxiliary attachments are screwed into the appropriate internally threaded receptors, they are not fully tightened. They are given several turns into the threads for attachment purposes but are not fully engaged so that the threads themselves provide rotatability for the various exercise auxiliary attachments.

Referring now to FIGS. 8–17, FIG. 8 depicts a bifurcated leg swing device 176 with arrow; it includes a pair of bifurcated generally V-shaped legs 177 and an externally threaded connector 178. It should be noted that the legs 177 are padded with foam rubber 179 or the like.

Figure 9:
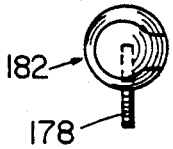
FIG. 9 is a baseball attachment.

FIG. 9 depicts a baseball 182 with arrow having an externally threaded connector 178 embedded therein. Ball 182 is grasped and the exerciser can complete a full throwing motion with a preselected resistance thereto.

Figure 10:
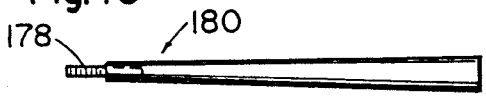
FIG. 10 is a golfclub attachment.

FIG. 10 depicts a golf club handle 184 with arrow having an externally threaded connector 178.

Figure 11:
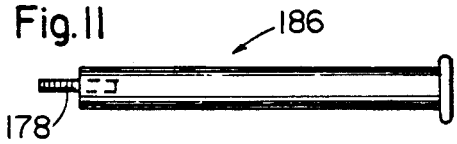
FIG. 11 is a baseball bat attachment.

FIG. 11 depicts a baseball bat handle 186 with arrow having externally threaded connector 178.

Figure 12:
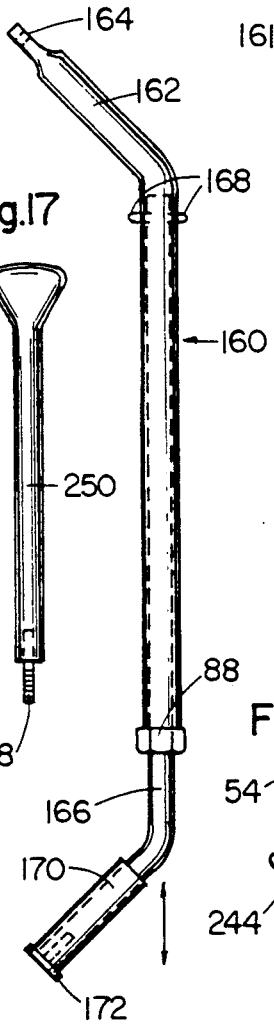
FIG. 12 is a swing arm attachment.

FIG. 12 depicts the previously described accessory member 160 with arrow and includes a larger tube 162 with a connector 164 for engaging the crank shaft of the flywheel. The inner tube 166 has a pair of detents 168 which communicate with a series of holes in the main tube 162 for extending and retracting the tube 166 thereby lengthening or shortening the overall accessory member 160. At the distal end of outer tube 162 compression nut 88 stabilizes inner tube 166 when in the desired position. At the distal end of bar 166 is a pivotal handle 170 which is retained by stop member 172.

Figure 13:
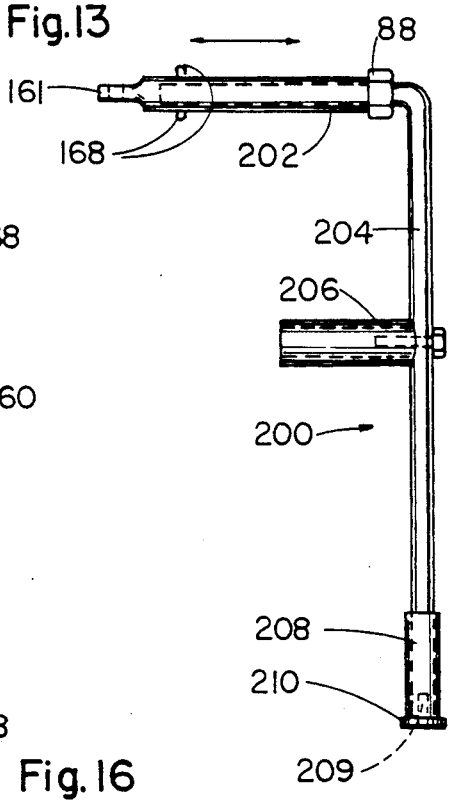
FIG. 13 is another swing arm attachment.

FIG. 13 shows a short arm accessory member 200 with arrow. This consists of a crankshaft connecting part 161, an outer round tubing 202 and an L-shaped bar 204 or tube which is smaller in diameter than tube 202 and which is slidably received within tube 202 with a similar adjustable detent assembly 168 for extending and retracting that part of the short accessory member 200. At the end of outer tube 202 compression nut 88 stabilizes inner tube 204 when in the desired position. Perpendicularly mounted padded handle 206 is parallel to part 202 and is spaced about twelve inches therefrom. Handle 206 may be bolted or welded to bar 204. At the distal end of bar 204 is a pivotal handle 208 similar to the handle 170 of bar 160 and said handle is retained by a stop member 210. Within the distal end of bar 204 is an internally threaded receptor 209 for receiving other auxiliary devices shown in the Figures.

Figure 14:
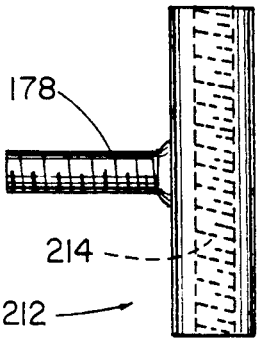
FIG. 14 is a T-shaped connector.

FIG. 14 discloses a T-shaped intermediate connector 212 having an externally threaded connector 178 and a cross member 214 which is threaded internally. T-shaped connector 212 joins accessory member 160 or 190 and a variety of auxiliary attachments shown in the figures. Connector member 212 has externally threaded part 178 screw threadedly received within receptor 174 or receptor 209 and part 214 that screw threadedly receives any of the various auxiliary simulated handles.

Figure 15:
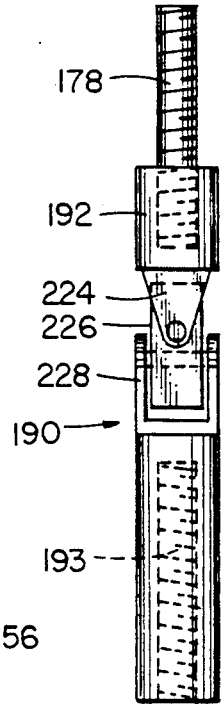
FIG. 15 is a universal joint connector.

FIG. 15 discloses another intermediate connector which is universally jointed. This connector is designated as 190 with arrow and it consists of an externally threaded connector 178 that is screw threadedly received within a first end of the universal joint 192. Clevis member 224 is pinned to an intermediate block 226 which is then pinned to another clevis member 228 that is secured to internally threaded receptor 193 which receives externally threaded parts of the various auxiliary attachments.

Figure 16:
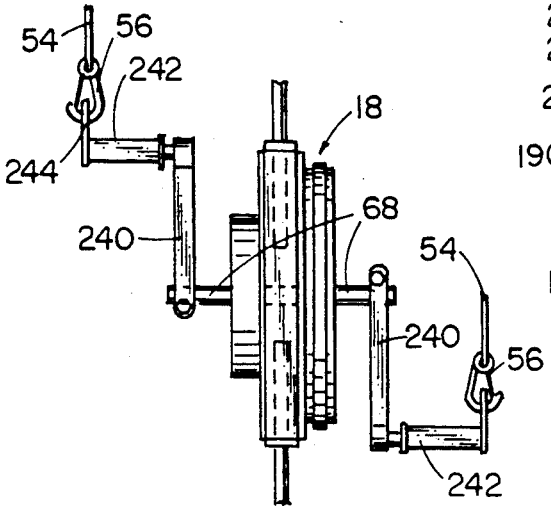
FIG. 16 shows the flywheel arrangement with the pedal cranks attached thereto.

FIG. 16 shows flywheel mechanism 18 including its protruding axle or crank shaft 68. In this view, it is shown with the bicycle pedal cranks 240, pedals 242, and brackets 244 attached to the pedals 242 to which the snap connectors 56 are attached.

It can therefore be understood that in the bicycle pedaling operation the cables 54, as they pass over the pulleys 52, produce a lengthening and shortening effect to the opposing T-handles 58, thereby providing an aerobic exercise for the arms simultaneously with the exercise associated with the pedaling of the bicycle pedals as best shown in FIG. 7.

Figure 17:
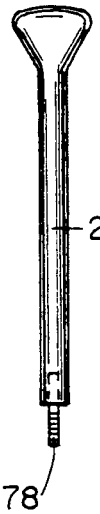
FIG. 17 shows part of a canoe paddle attachment.

FIG. 17 discloses a part of a canoe paddle 250 with arrow, bulbous handle part 252 and externally threaded connector 178.

Figure 6:
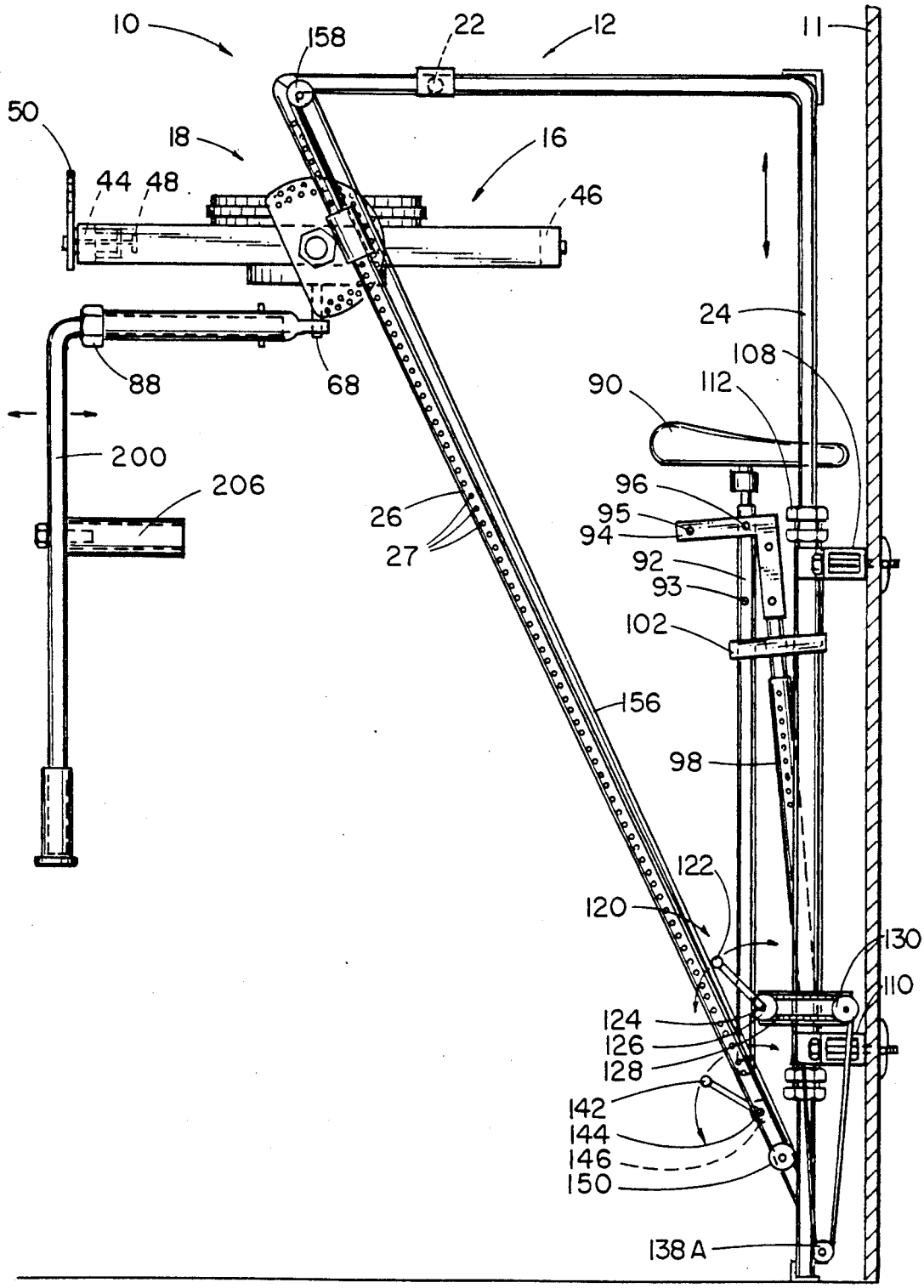
FIG. 6 is a side elevational view with the flywheel in an overhead, elevated horizontal position with one of the various accessory members attached thereto.

FIG. 6 is a side elevational view of the machine; the gyroscopically connected frame 16 is shown disposed in a generally horizontal position near the top of the triangular frame 12 which triangular frame 12 is raised to an elevated position so that the exerciser may stand underneath it. The short arm accessory member 200 is shown attached to the crank shaft axle 68 of the flywheel mechanism 18.

Figure 22:
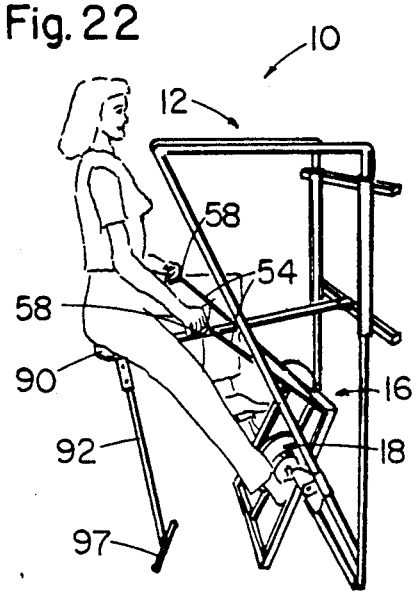
FIG. 22 is a side elevational view of this embodiment in a bicycle pedaling configuration including a human figure.

FIG. 7 is a side elevational view of the device lowered to the bicycle pedaling exercise. Rectangular frame 16 is shown in its lowermost position as is the triangular pair of frames 12. Also, flywheel housing 18 is shown vertically rotated to a position that is 180° and perpendicular to rectangular frame 16. The bicycle seat frame has been swung down and pinned with the holes 93 and 95 in mutual alignment to stabilize the seat. A human figure is shown in FIG. 22, pedaling the bicycle and utilizing the aerobic arm devices which includes cables 54 and the T-handles 58.

Figure 20:
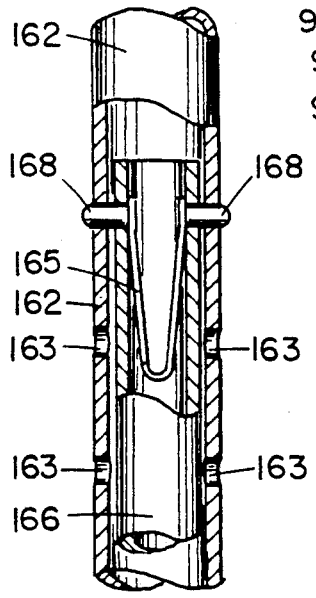
FIG. 20 is a partially cross sectional view of a pair of telescoping tubes having a detent device.
Figure 8:
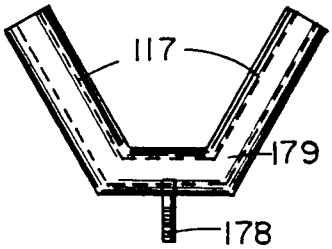
FIG. 8 is a generally V-shaped padded leg attachment.

FIG. 20 depicts in detail the adjustable telescoping tube features of the various components that utilize this type of adjustment means. For example, in accessory member 160 having an inner tube 166 and outer tube 162 there are detent holes 163 which communicate with the spring loaded detents 168. As the detents 168 are pressed radially inwardly against the leaf spring 165, the detents slide within the tube 162 until released to the desired positioning holes 163 to thereby achieve the preferred extension or retraction of the particular device.

Figure 18:
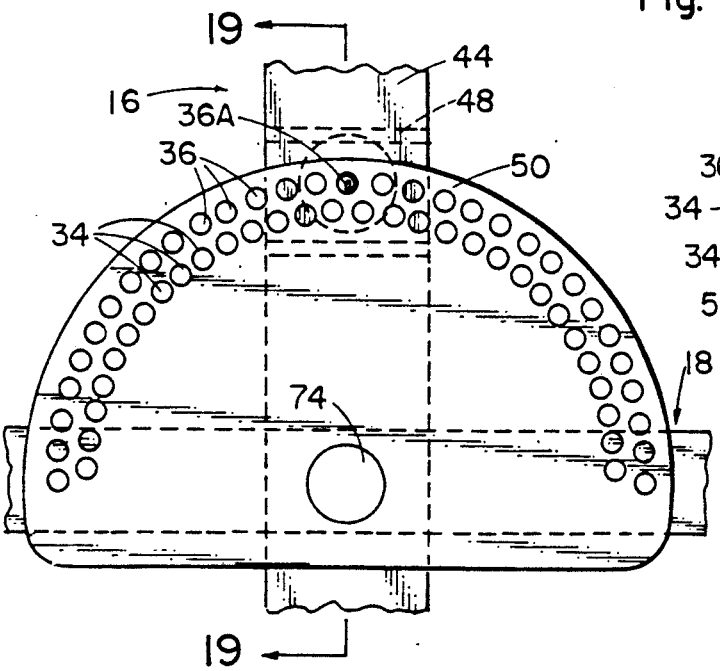
FIG. 18 is an enlarged view of one of the two stop members.
Figure 19:
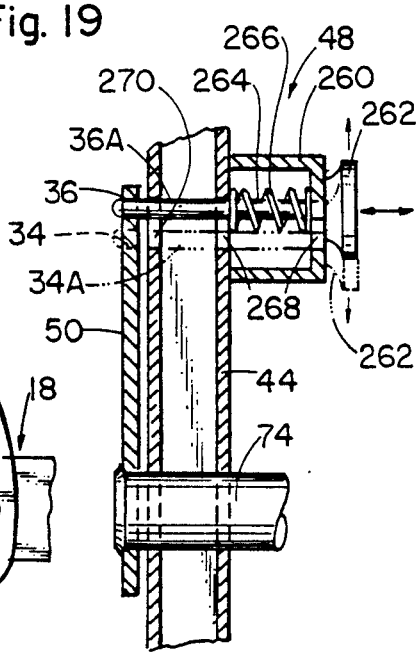
FIG. 19 is a cross section of said stop member and related parts taken along line 19—19 in FIG. 18.

FIG. 18 depicts, in detail, indexing dial or stop member 50 which is positioned above the horizontal member 44 of frame 16. Flywheel assembly 18 and dial 50 are shown in the bicycle configuration as depicted in FIG. 7. Dial 50, which is similar to dial 32, has two radially spaced rows of circumferentially spaced holes or perforations collectively denoted 34 and 36. The holes in each row of holes are spaced at six degree intervals and each row is offset three degrees relative to its counterpart, thereby providing three degree increments about the face of the semi-circular dial. Thus, as the detents are located in the various holes, the user has the choice of any degree of angularity within three degree increments by use of one row of holes or the other. Dial 50 is permanently affixed to the pintel or shaft 74 and rotates with that shaft, and frame 44 carries the spring loaded detent arrangements 48 as perhaps best shown in FIG. 3. As shown in FIG. 19, taken from FIG. 18, the detent arrangement 48 includes a generally U-shaped part 260 which is affixed to the member 44. Knob 262 is attached to a shaft 264 which protrudes all the way through member 44 and into dial 50. This shaft 264 is mounted in such a manner as to be spring loaded by the spring 266. A pair of slotted holes 268 are formed in U-shaped part 260 so that shaft 264 may be positioned in registration with either the radially outer row of holes 36 or the radially inner row of holes 34, as indicated in phantom lines in FIG. 19. To adjust the angularity of the flywheel mechanism 18, knob 262 is pulled outwardly and positioned in a manner so that the end of shaft 264 rests upon the intermediate wall between the two rows of holes in the dial 50, i.e., the pin actually rests against the inner wall of the member 44 at a location indicated by the numeral 270 so that the dial and the flywheel housing 18 can be rotated in either direction without interference from the shaft 264. Thus, the shaft rests at a point between the holes 34A and 36A of the member 44 at a point designated as 270. Once flywheel 18 has been positioned at the angularity desired, then the knob 262 is grasped and the shaft 264 is slid into the position that aligns either 34A with 34 or 36A with 36. The plunger pin 264 is then released into the appropriate hole of the dial 50 thereby locking the device in the desired position of angularity. There are a pair of stops 48 so that the dial 50 may communicate at one time or another with either of the stop mechanisms 48 without requiring a full circle dial.

It should be noted that the semi-circular dial 32 is rigidly attached to the member 28 and the rectangular frame 16 has a three hundred and sixty degree rotatability on its horizontal axis. The means of positioning and detaining the frame 16 against the dial 32 is very similar to that which has just been described except that the dial is permanently affixed to the journal 28 as distinguished from being affixed to the shaft 74. The detent arrangement works in the same way as that disclosed in FIG. 18 and 19.

Figure 21:
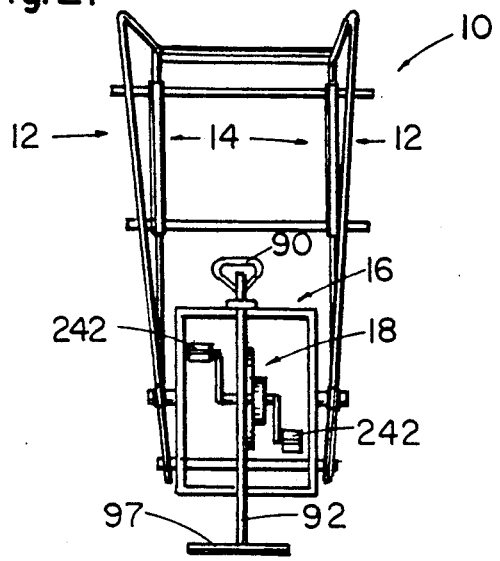
FIG. 21 is a frontal elevational view of this embodiment in the bicycle pedaling configuration.

FIG. 21 is a frontal view of the apparatus in the bicycle pedaling configuration.

FIG. 22 shows a figure in the bicycle configuration with the feet on the pedals 242 and the hands holding the T-handles 58 attached to the cables 54. The T-handles 58 are being grasped by the user and as the user pedals it imparts a reciprocating motion to the arms.

Figure 23:
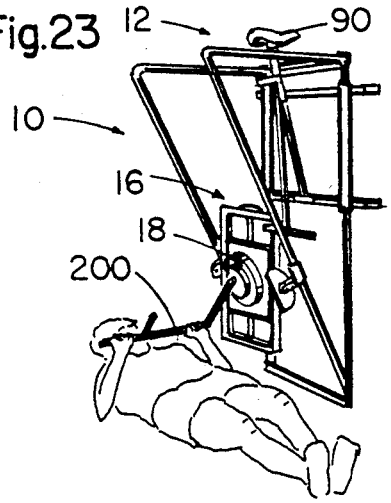
FIG. 23 is a perspective view of the device in a pushup configuration.
Figure 24:
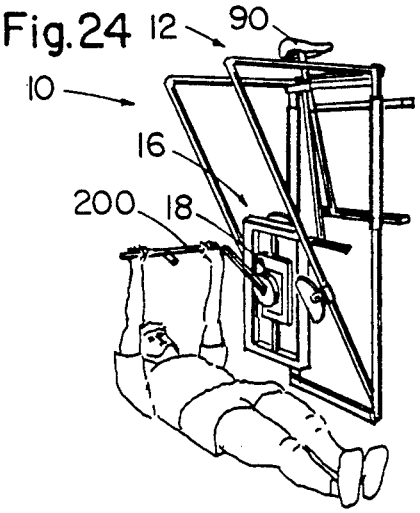
FIG. 24 is another perspective view of the pushup exercise configuration.

FIGS. 23 and 24 disclose an exercise mode involving bench press exercises. FIG. 23 is at the beginning of the bench press exercise and FIG. 24 is at the extension of the arms in the bench press exercise.

Figure 25:
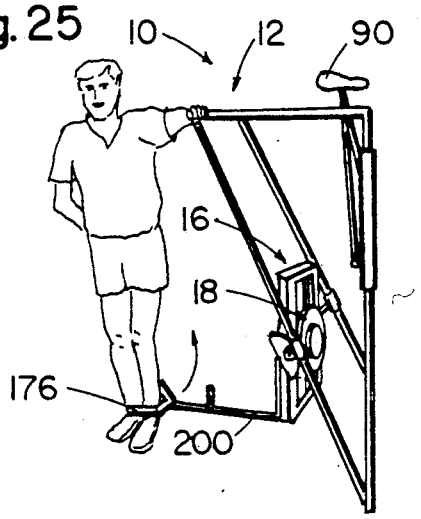
FIG. 25 is a perspective view of a leg curl exercise in the beginning position.
Figure 26:
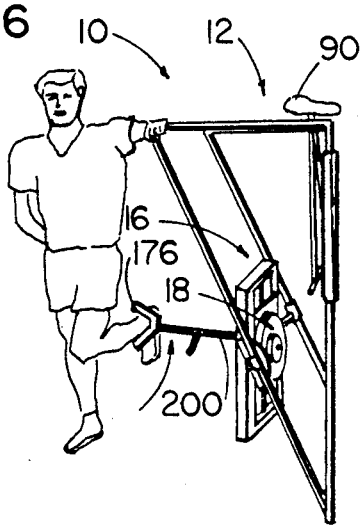
FIG. 26 is another perspective view of the leg curl exercise in a later position of the exercise.

FIG. 25 shows a primary position for a leg curl exercise and FIG. 26 shows the secondary position of the leg curl exercise.

Figure 27:
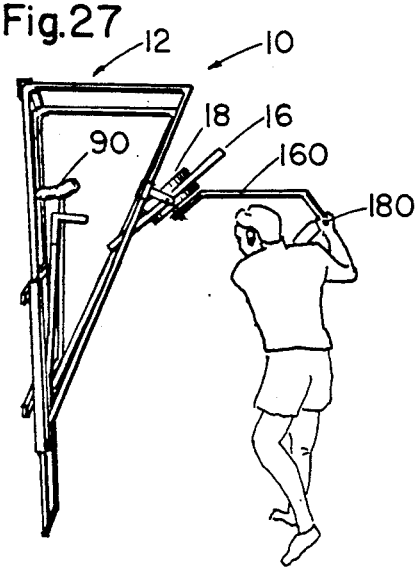
FIG. 27 is a perspective view of the novel apparatus with the user shown in the upswing or backswing part of a golfclub swing exercise.
Figure 28:
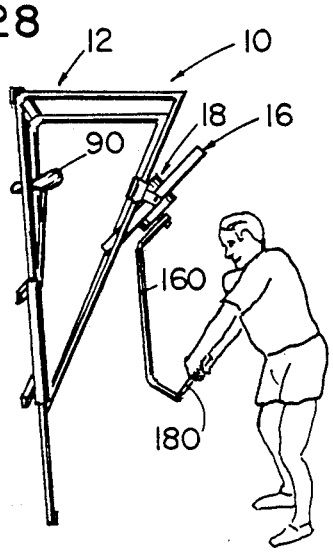
FIG. 28 shows the same embodiment with the user at the downstroke of a golf swing.

FIG. 27 shows the apparatus configured so that the user can practice a golf swing; FIG. 27 shows the primary back swing position and FIG. 28 shows the mid swing position.

Figure 29:
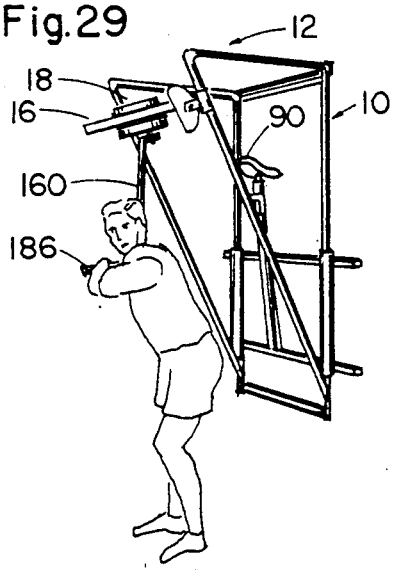
FIG. 29 is a perspective view of the apparatus with the user at the beginning of a baseball batting swing.
Figure 30:
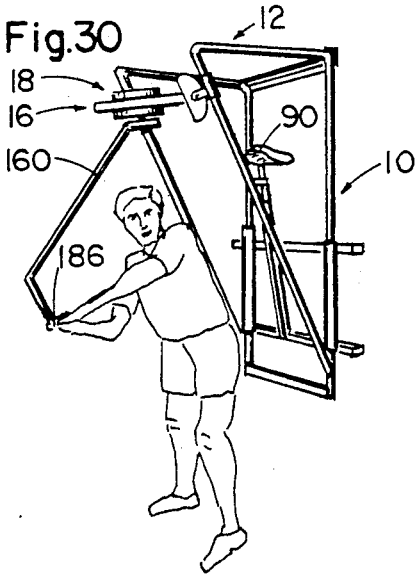
FIG. 30 depicts the same exercise at mid-swing of the baseball swing exercise.

FIG. 29 depicts the apparatus with the user in a baseball batting primary position and FIG. 30 shows said user at mid swing.

Figure 31:
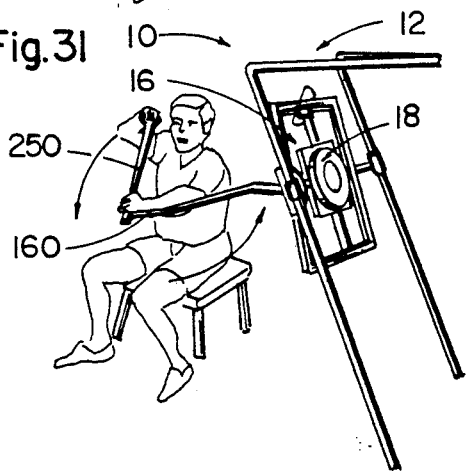
FIG. 31 shows the user seated and executing the beginning of a canoe paddling exercise.
Figure 32:
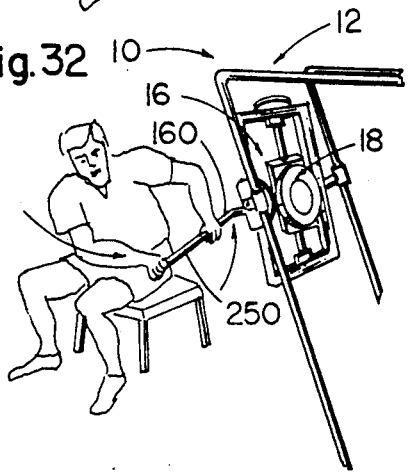
FIG. 32 is a perspective view of the user in a secondary position of a canoe paddling exercise.

FIG. 31 shows the user seated on a stool with the apparatus oriented in a manner to provide a canoe paddling exercise. FIG. 31 shows the primary position for the beginning of the stroke and FIG. 32 shows the final position of the canoe paddling stroke.

FIGS. 21 through 32 disclose some of the basic exercises that may be performed with the novel apparatus. There are many, many others and users of the novel apparatus may devise many of their own specific exercises that develop coordination and/or strength for a given sport or endeavor.

This invention is clearly new and useful. Moreover, it was not obvious to those of ordinary skill in this art at the time it was made, in view of the prior art, considered as a whole in accordance with the requirements of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. An exercise machine, comprising:

a pair of laterally spaced apart triangular support members;

each of said support members including a vertical back frame member, a horizontal top frame member that projects forwardly with respect to said back frame member, and a diagonally disposed frame member that extends in interconnecting relation between a forwardmost end of said top frame member and a lowermost end of said back frame member;

a rotatably mounted flywheel member having an adjustable resistance positioned intermediate said triangular support members in general and intermediate said diagonally disposed frame members in particular;

said flywheel member having an axle that defines its axis of rotation;

a non-rotatably mounted housing for said flywheel member;

a first transversely disposed mounting pintel having an inner end secured to a first side of said housing and an outer end movably secured to an associated diagonally disposed frame member;

a second transversely disposed mounting pintel having an inner end secured to a second side of said housing and an outer end movably secured to an associated diagonally disposed frame member;

a preselected accessory means that simulates a piece of athletic equipment being secured to said flywheel axle;

means for adjusting the resistance of said flywheel member;

said flywheel housing being rotatable about an axis of rotation collectively defined by said first and second mounting pintels;

stop means for holding said flywheel housing and hence said flywheel member in a preselected position of rotation about said axis of rotation;

whereby an exerciser may preselect an accessory means and an angular position for said flywheel member and perform at least one exercise by moving said accessory means against the resistance offered by said flywheel member.

2. The machine of claim 1, wherein said first and second mounting pintels and hence said flywheel member and flywheel housing are moveable along the extent of said diagonally disposed frame members to increase the number of exercises performable with said machine and to accommodate exercisers of differing heights.

3. The machine of claim 2, wherein said back frame members and said diagonally disposed frame members are telescopically constructed so that their respective lengths are selectively adjustable to increase the versatility of the machine.

4. The machine of claim 3, further comprising a counterweight means connected to said first and second mounting pintels to facilitate movement of said first and second mounting pintels along the respective extents of said diagonally disposed frame members.

5. An exercise machine, comprising:

a pair of laterally spaced apart triangular support members;

each of said support members including a vertical back frame member, a horizontal top frame member that projects forwardly with respect to said back frame member, and a diagonally disposed frame member that extends in interconnecting relation between a forwardmost end of said top frame member and a lowermost end of a back frame member;

a rotatably mounted flywheel member, having an adjustable resistance, positioned intermediate said triangular support members in general and intermediate said diagonally disposed frame members in particular;

said flywheel member having an axle that defines its axis of rotation;

a non-rotatably mounted housing for said flywheel member;

a frame disposed in surrounding relation to said flywheel member;

said frame member including a top wall, a bottom wall, and a pair of transversely spaced apart first and second side walls that interconnect opposite ends of said top and bottom walls;

a first mounting pintel disposed in interconnecting relation to said first frame side wall and an associated diagonally disposed frame member;

a second mounting pintel disposed in interconnecting relation to said second frame side wall and an associated diagonally disposed frame member;

a third mounting pintel disposed in interconnecting relation to said frame top wall and said flywheel housing;

a fourth mounting pintel disposed in interconnecting relation to said frame bottom wall and said flywheel housing;

said first and second mounting pintels collectively defining a horizontal axis of rotation about which said frame and hence said flywheel and flywheel housing are conjointly rotatable;

said third and fourth mounting pintels collectively defining a second axis of rotation about which said frame and hence said flywheel and flywheel housing are conjointly rotatable;

said second axis of rotation being disposed orthogonally with respect to said horizontal axis of rotation.

6. The machine of claim 5, further comprising a first stop member for locking said frame and hence said flywheel in a preselected position of rotation about said horizontal axis of rotation.

7. The machine of claim 6, further comprising a second stop member for locking said frame and hence said flywheel in a preselected position of rotation about said axis of rotation that is orthogonal to said horizontal axis of rotation.

8. The machine of claim 7, wherein said first and second stop members are flat plate members having plural perforations formed therein, said perforations being arranged in an arcuate pattern.

9. The machine of claim 8, further comprising detent members mounted to said frame member that are adapted to selectively engage preselected perforations in their associated plate members to hold said flywheel in a preselected position of angular adjustment.

10. The machine of claim 9, wherein said perforations are provided in two radially spaced rows and wherein each perforation in each row is circumferentially spaced apart from its contiguous perforations by about six degrees of arc and wherein the rows are circumferentially staggered about three degrees so that the frame member is positionable at differing angles of adjustment in three degree increments.

11. The machine of claim 7, further comprising:

a bicycle seat assembly;

said assembly including a bicycle seat;

a post for supporting said bicycle seat;

a hingedly mounted swing arm member for linking said bicycle seat to a preselected part of said machine;

said post part of said machine being hingedly mounted to said swing arm member;

said assembly being foldable into a storage position when said post and swing arm member are in closely spaced, substantially parallel relation to one another;

said assembly being deployable into an operable position wherein said post is substantially upright and said swing arm member is substantially parallel to a support surface upon which said machine is positioned;

a pair of pedals and a pair of crank arms being attachable to opposite ends of said flywheel axle;

said flywheel being positioned below said swing arm member; and said flywheel axle being transversely disposed and locked into said transversely disposed position;

whereby exercise of the type employing stationary bicycle equipment is provided by said machine.

12. The machine of claim 7, further comprising a preselected accessory member that is releasably attachable to said flywheel axle, said accessory member simulating a piece of athletic equipment.

13. The machine of claim 12, wherein said accessory member is of elongate construction, has a first end that engages said flywheel axle, and a second free end adapted to releasably engage preselected auxiliary handle members that simulate handles of preselected pieces of athletic equipment.

14. The machine of claim 13, wherein said second free end is internally threaded to thereby rotatably receive said auxiliary handle members.

15. The machine of claim 14, wherein said auxiliary handle members are also pivotally secured to said second free end so that said auxiliary handle members are rotatably and pivotally mounted with respect to said second free end and wherein a pivotal axis of said handle members is orthogonally disposed with respect to said second free end.

16. The machine of claim 15, wherein said accessory member is of telescoping construction.

17. The machine of claim 11, wherein said machine includes a pair of transversely disposed brace members that are vertically spaced with respect to one another and that interconnect said back frame members wherein said brace members are movably attached at their respective opposite ends to said back frame members, and wherein said preselected part of said machine to which said swing arm is attached is a preselected brace member of said pair of brace members.

* * * * *